US005664496A

United States Patent [19]

Scheuhing et al.

[11] Patent Number: 5,664,496

[45] Date of Patent: Sep. 9, 1997

[54] DOCTORING INK CUP

[75] Inventors: Robert B. Scheuhing, Rindge; Edward H. Wilson, Jr., Marlborough, both of N.H.

[73] Assignee: Markem Corporation, Keene, N.H.

[21] Appl. No.: 356,908

[22] Filed: Dec. 15, 1994

[51] Int. Cl.[6] ..... B41F 9/08

[52] U.S. Cl. ..... 101/169; 101/163

[58] Field of Search ..... 101/41–44, 150, 101/157, 158, 159, 160, 161, 163, 169, 170, 167, 359, 360

[56] References Cited

U.S. PATENT DOCUMENTS

| | | | |
|---|---|---|---|
| 3,468,252 | 9/1969 | Lemelson | 101/379 |
| 4,040,348 | 8/1977 | Gertsch et al. | 101/350 |
| 4,060,031 | 11/1977 | Philipp | 101/163 |
| 4,222,328 | 9/1980 | Doyle | 101/350 |
| 4,314,504 | 2/1982 | Combeau | 101/41 |
| 4,508,032 | 4/1985 | Philipp | 101/163 |
| 4,557,195 | 12/1985 | Philipp | 101/163 |
| 4,581,995 | 4/1986 | Stone | 101/366 |
| 4,590,855 | 5/1986 | Schommer et al. | 101/157 |
| 4,615,266 | 10/1986 | DeRoche et al. | 101/163 |
| 4,667,595 | 5/1987 | Geretzki | 101/207 |
| 4,905,594 | 3/1990 | Phillip et al. | 101/163 |
| 4,938,133 | 7/1990 | Bock et al. | 101/349 |
| 4,964,336 | 10/1990 | Bock et al. | 101/157 |
| 4,998,475 | 3/1991 | John et al. | 101/366 |
| 5,003,872 | 4/1991 | Dalferth | 101/163 |
| 5,054,392 | 10/1991 | Greenwood | 101/142 |
| 5,088,401 | 2/1992 | Fujino et al. | 101/41 |
| 5,150,651 | 9/1992 | Flores | 101/207 |
| 5,272,972 | 12/1993 | Tobita | 101/163 |
| 5,272,973 | 12/1993 | Chojnacki | 101/163 |
| 5,320,037 | 6/1994 | Harris | 101/163 |

FOREIGN PATENT DOCUMENTS

| | | |
|---|---|---|
| 0359955 | 3/1990 | European Pat. Off. . |
| 0474262 | 3/1992 | European Pat. Off. . |
| 0568133 | 11/1993 | European Pat. Off. . |
| 0581096 | 2/1994 | European Pat. Off. . |
| 90/06932 | 8/1990 | Germany . |
| 92/15067 | 3/1993 | Germany . |
| 56-28861 | 3/1981 | Japan . |
| 62-28281 | 7/1985 | Japan . |
| 2171645 | 9/1986 | United Kingdom . |

OTHER PUBLICATIONS

"Compact Pad Printer for Industrial products and Electronic Packages" brochure from Marken Corporation, (1993, Jan.).

"Compact Pad Printer for Industrial Products and Electronic Packages," brochure from Markem Corporation, 4 pages (1993, Jan.).

"Markem Model 590 Service and Repair Manual," manual from Markem Corporation, pp. 1–1 –9–2 (1994, Apr.).

"Markem Model 590 Operator's Manual," manual from Markem Corporation, pp. 1–1 –8–4 (1994, Apr.).

*Primary Examiner*—Christopher A. Bennett

*Attorney, Agent, or Firm*—Hamilton, Brook, Smith & Reynolds, P.C.

[57] ABSTRACT

A doctoring ink cup for containing and applying ink to an engraved image on a printing plate includes a flexible doctoring cup drawn from a sheet of spring steel. The doctoring cup has rim forming a doctoring edge for wiping excess ink from the printing plate. A cup shaped stiffening member is bonded to the doctoring cup for stiffening the doctoring cup.

18 Claims, 7 Drawing Sheets

DOCTORING INK CUP

BACKGROUND

Pad-type printers are commonly used for printing text or images onto three-dimensional articles. Typically, a pad type printer includes a horizontal reciprocating printing plate having an image engraved onto the surface of the printing plate. The engraved image is commonly supplied with ink from an open reservoir or trough by means of a brush, spreader blade, roller or wire applicator. A doctor blade is then used to remove excess ink from the printing plate so that the ink remains only in the recessed regions of the engraved image. Finally, a rubber printing pad transfers the ink from the engraved image to a desired article.

A problem with pad-type printers having open ink reservoirs is that the ink has a tendency to evaporate from the open reservoir. Ink evaporation is undesirable in that the viscosity of the ink changes as the ink evaporates. Additionally, the evaporating ink causes vapors, creating a health concern. In order to reduce ink evaporation, many current pad-type printers employ closed ink cups. By reducing ink evaporation, vapors are reduced and the viscosity of the ink is more consistent, thereby increasing ink life.

A closed ink cup is usually a cup shaped member which is inverted over the printing plate so that the printing plate holds the ink within the ink cup. The rim of the ink cup contacts the printing plate and serves as a doctoring edge. Ink is supplied to the engraved image when the engraved image is translated beneath the ink cup. The doctoring edge wipes excess ink from the printing plate while leaving sufficient ink on the engraved image.

One common type of closed ink cup is a one-piece cup machined from a single block of steel. One-piece ink cups are precision machined in a lathe or a computer controlled milling machine and are then heat-treated to harden the doctoring edge. The doctoring edge is then lapped to provide a flat and consistent surface. Problems with one-piece ink cups are that they are easily damaged because they are brittle and they are expensive to manufacture. If the doctoring edge of a one-piece ink cup is damaged (for example, scratched, chipped or cracked), the ink cup must be replaced or repaired because a damaged doctoring edge will cause the ink cup to leak. Additionally, the use of a one-piece ink cup usually requires the use of an expensive precision ground printing plate. A one-piece ink cup is rigid and is not capable of satisfactorily wiping ink from the surface of an inexpensive non-precision ground printing plate because the doctoring edge cannot flex to follow the ripples and craters on the surface of the printing plate.

The replacement of an entire ink cup can be very expensive. U.S. Pat. No. 5,320,037 proposes a multiple part ink cup having a replaceable sheet metal band which forms the doctoring edge. As a result, only the doctoring edge requires replacement if damaged. However, the large number of interlocking parts forming this ink cup makes it both difficult to clean and expensive.

SUMMARY OF THE INVENTION

Accordingly, there is a continuing need for a closed ink cup which is both inexpensive and easy to clean.

In accordance with the invention, a doctoring ink cup includes a doctoring member drawn from a blank of sheet material. In preferred embodiments, the doctoring member is cup shaped and has a flexible rim forming a doctoring edge. A stiffening member in engagement with the doctoring member stiffens the doctoring member to control the flexibility of the doctoring member.

In preferred embodiments, the doctoring member is bonded to the stiffening member within the stiffening member. The doctoring member is drawn from a blank punched on a sheet metal stamping press from a sheet of unhardened spring steel with a punch and die. The wall thickness of the doctoring member ranges from about 0.008 inches to 0.015 inches thick. After the doctoring member is drawn, the doctoring edge of the doctoring member is trimmed. The doctoring member is then hardened by heat treating. After assembly, the doctoring edge of the doctoring member is lapped to provide a flat and consistent surface.

The stiffening member in one preferred embodiment is drawn from a blank of sheet metal into a cup shaped member. In another preferred embodiment, the stiffening member is molded into a cup shaped member through a molding process. In still another preferred embodiment, a cup shaped secondary support member is pressed inside the doctoring member.

The present invention provides a closed doctoring ink cup which is easy to clean due to the small number of parts in its design and the lack of discontinuities exposed to ink. The present invention ink cup is also inexpensive enough to be disposable due to its unique method of manufacture. Additionally, the doctoring ink cup of the present invention can be used in conjunction with less expensive printing plates that are not precision ground. The doctoring edge can be made with enough compliance to follow ripples and craters on the surface of non-precision printing plates to more thoroughly wipe excess ink from the printing plate than rigid one piece ink cups. Furthermore, since the doctoring edge of the ink cup may be flexible, it is not as easily damaged as the doctoring edges of ink cups machined from a single block of steel.

A novel ink cup holder is provided for pressing an ink cup against a printing plate. The ink cup holder has a recess for receiving and retaining the ink cup. The recess has a surface with a protrusion extending into the recess at a central location of the recess. The protrusion presses against the center of the ink cup to press the doctoring edge of the ink cup evenly against the printing plate. This allows the doctoring edge and printing plate to wear more evenly and experience a longer life.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
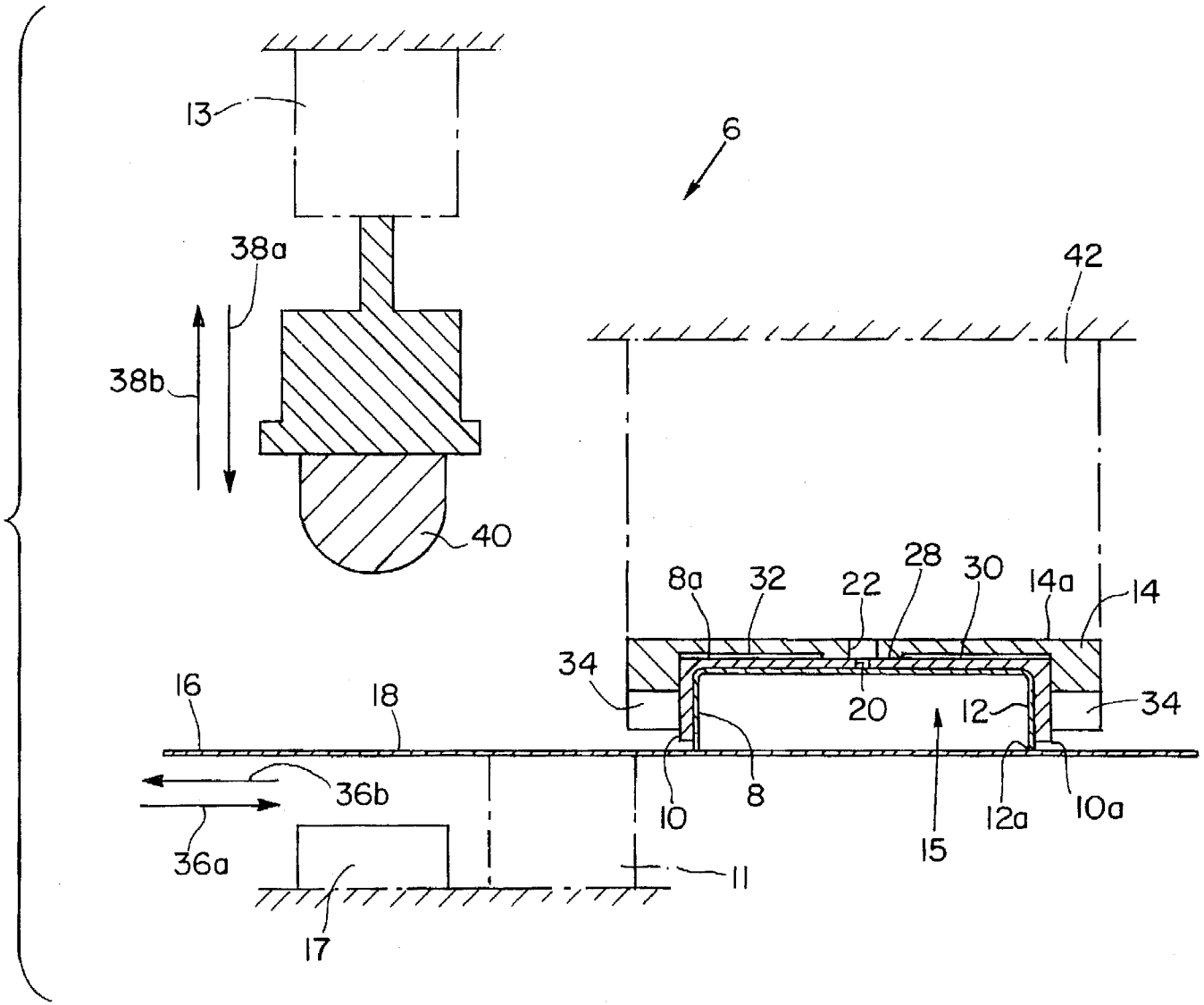
FIG. 1 is a schematic side sectional view of a pad-type printer employing a preferred embodiment of the present invention ink cup.
Figure 2:
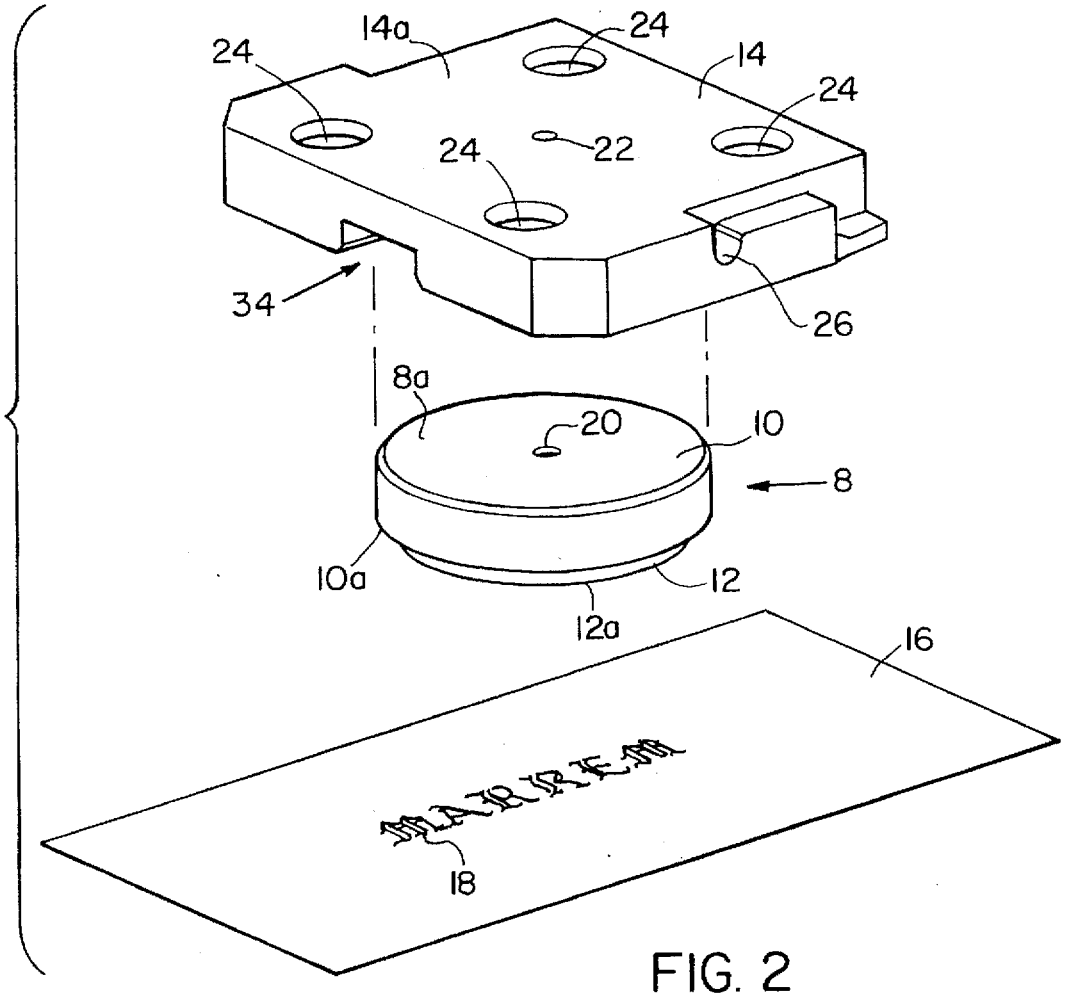
FIG. 2 is an exploded perspective view of the ink cup, the ink cup holder and printing plate of FIG. 1.
Figure 3:
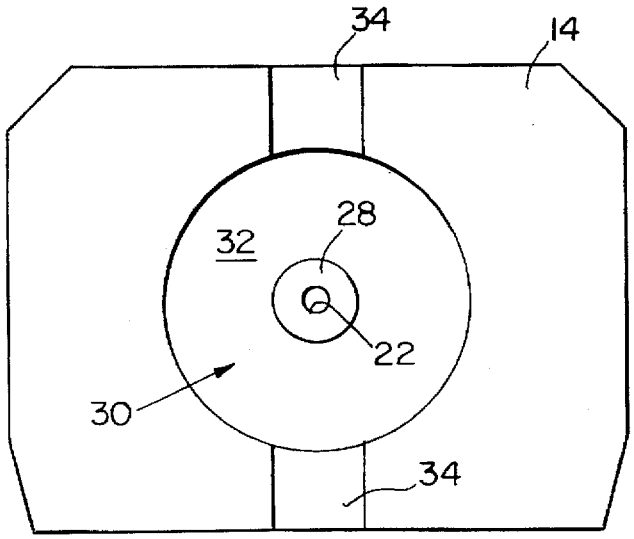
FIG. 3 is a front view of the ink cup holder showing the recess for supporting the present invention ink cup.
Figure 4:
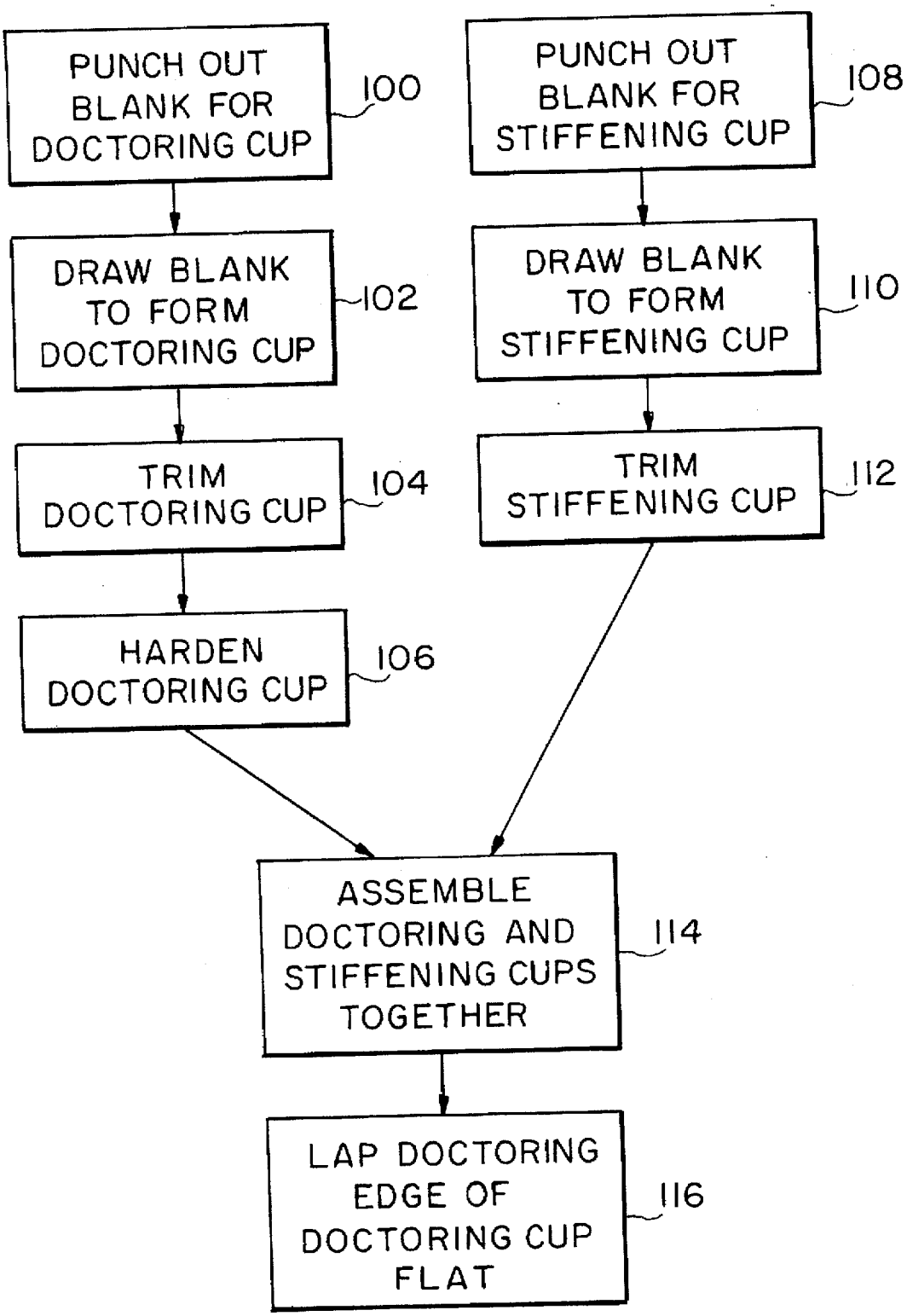
FIG. 4 is a flow chart depicting the steps for manufacturing a preferred embodiment of the present invention ink cup.

Referring to FIGS. 1 through 3, pad-type printer 6 includes a printing plate 16 which is translatable in the horizontal direction by horizontal actuator 11. Printing plate 16 includes an image 18 (FIG. 2) engraved into the surface of printing plate 16. A bottomless ink cup 8 containing a supply of ink within reservoir 15 is retained on the plate 16 by an ink cup holder 14 to supply ink to engraved image 18. Ink cup clamp 42 exerts a downward force onto ink cup holder 14 to press the doctoring edge 12*a* of ink cup 8 against printing plate 16. Doctoring edge 12*a* contacts printing plate 16 to seal ink within reservoir 15 as well as to wipe excess ink from printing plate 16 when printing plate 16 is translated relative to ink cup 8. A vertically reciprocating printing pad 40 for transferring ink from engraved image 18 to a desired article 17 is raised and lowered by vertical actuator 13. Ink cup clamp 42 is preferably manually activated and spring-loaded. However, alternative clamping mechanisms can be used.

In order to load ink cup 8 into printer 6, ink cup 8 is first inserted into recess 30 of ink cup holder 14 with the doctoring edge 12*a* facing upwards. Magnets 24 retain ink cup 8 within recess 30. Ink cup 8 is then filled with ink. Next, printing plate 16 is placed over ink cup 8 to enclose reservoir 15. The ink cup 8, ink cup holder 14 and printing plate 16 assembly is flipped over so that the ink cup 8 is located on top of printing plate 16. The magnets 24 within ink cup holder 14 attract printing plate 16 to ink cup 8 which prevents the ink from leaking between the printing plate 16 and ink cup 8. The ink cup 8, ink cup holder 14, and printing plate 16 assembly is then installed within printer 6 with printing plate 16 being coupled to horizontal actuator 11. Ink cup 8 is then pressed against printing plate 16 by coupling ink cup clamp 42 to ink cup holder 14 and actuating ink cup clamp 42.

In operation, the ink contained within reservoir 15 of ink cup 8 is applied to engraved image 18 when printing plate 16 is translated in the direction of arrow 36*a* by horizontal actuator 11 to position engraved image 18 under ink cup 8. Printing plate 16 is then translated in the direction of arrow 36*b* back to its original position to locate engraved image 18 under printing pad 40. The doctoring edge 12*a* of doctoring cup 12 removes any excess ink from printing plate 16, and at the same time, leaves sufficient ink on engraved image 18. Printing pad 40 is then moved downward in the direction of arrow 38*a* by vertical actuator 13 to contact engraved image 18 in order to transfer the ink from the engraved image 18 onto printing pad 40. Printing pad 40 then moves upward in the direction of arrow 38*b*. Printing plate 16 is translated again in the direction of arrow 36*a* to resupply ink to engraved image 18. When engraved image 18 is positioned below ink cup 8, printing pad 40 is translated downwards in the direction of arrow 38*a* to transfer the ink from printing pad 40 onto article 17. Printing pad 40 then moves upward in the direction of arrow 38*b* back into its original position and printer 6 is ready to print another article 17.

Ink cup 8 includes an inner flexible doctoring cup 12 and an outer stiffening cup 10. Doctoring cup 12 has a rim forming a doctoring edge 12*a*. Doctoring cup 12 is drawn from a circular blank of unhardened spring steel into a cup shaped member and subsequently hardened. Since doctoring cup 12 is formed of sheet material having uniform thickness, the doctoring edge 12*a* maintains a constant thickness as it experiences wear from use. The wall thickness of doctoring cup 12 is preferably between 0.008 inches and 0.015 inches with 0.010 inches being the preferred thickness. Doctoring cup 12 at this thickness is flexible and, therefore, requires stiffening in order to operate properly.

Outer stiffening cup 10 is bonded to the exterior of doctoring cup 12 with epoxy to stiffen doctoring cup 12 so that the doctoring cup 12 and doctoring edge 12*a* do not flex excessively during operation. By bonding the doctoring cup 12 and stiffening cup 10 together, portions of the doctoring cup 12 adjacent to the stiffening cup 10 acquire the structural stiffness of the two cups combined. As a result, the portions of doctoring cup 12 adjacent to stiffening cup 10 do not flex significantly. Although the doctoring edge 12*a* extends below the rim 10*a* of the stiffening cup 10 (at least 0.010 inches), the doctoring edge 12*a* is still stiffened considerably by stiffening cup 10. Stiffening cup 10 is thicker than doctoring cup 12 (typically at least 1/16 inch thick) and is drawn from a circular blank of sheet metal. Stiffening cup 10 does not require hardening since it does not have any wear surfaces. A hole 20 in the center of stiffening cup 10 allows air to escape during assembly.

The flexibility of doctoring cup 12 and doctoring edge 12*a* can be controlled by the stiffness of stiffening cup 10. For example, a more compliant stiffening cup 10 is desirable when printing plate 16 is a low cost plate having a surface with ripples and craters. This allows doctoring edge 12*a* to have enough flexibility to follow the ripples and craters in printing plate 16 to more thoroughly wipe excess ink from the printing plate. If a rigid stiffening cup 10 is employed, the doctoring edge 12*a* becomes rigid so that a precision ground plate is typically used. The stiffness of stiffening cup 10 can be controlled by its thickness or by the material from which the cup is formed.

Ink cup 8 fits within recess 30 of ink cup holder 14. Recess 30 terminates at surface 32. An annular protrusion 28 having a flat surface extends from the center of the surface 32 into recess 30 about 0.010 inches to 0.030 inches. Protrusion 28 presses against the center of the rear 8*a* of ink cup 8. The force is distributed radially down the sides of ink cup 8 to doctoring edge 12*a* which presses the doctoring edge 12*a* of ink cup 8 against printing plate 16 evenly over the entire length of doctoring edge 12*a*. Accordingly, the doctoring edge 12*a* of ink cup 8 does not tip relative to printing plate 16 or wear unevenly. Also, the printing plate 16 experiences less wear.

There are several factors which allow protrusion 28 to press doctoring edge 12*a* evenly onto printing plate 16. The first is that ink cup 8 pivots about protrusion 28 so that the doctoring edge 12*a* of ink cup 8 can follow and adjust for any irregularities in the surface of printing plate 16. The second is that the roof of ink cup 8 flexes slightly to compensate for any irregularities in printing plate 16 or doctoring edge 12*a*. The third is that by concentrating the clamping force exerted by ink cup clamp 42 at the center of the ink cup 8, the clamping force is distributed evenly on the sides of ink cup 8. The fourth is that the flat surface of protrusion 28 is small which allows the surface to be made flat.

Ink cup holder 14 has four magnets 24 (FIG. 2) for holding ink cup 8 within recess 30 as well as attracting printing plate 16 to ink cup 8 to prevent ink from leaking from ink cup 8 during installation or removal. Two grooves 26 are located on opposite sides of ink cup holder 14 which allow ink cup clamp 42 to clamp down on ink cup holder 14. A hole 22 extending between surface 14*a* and recess 30 allows air to escape from recess 30 when ink cup 8 is inserted into recess 30. Hole 22 also allows ink cup 8 to be pushed from ink cup holder 14 with a tool. Channels 34 on the front of ink cup holder 14 also provide access for one's fingers to grasp ink cup 8 for insertion or removal. In an alternative but less preferred embodiment, protrusion 28 can be omitted.

Referring to FIGS. 4–8, the process for manufacturing ink cup 8 is shown. In step 100, a circular blank 124 for doctoring cup 12 is punched from a sheet of unhardened spring steel 122 on a sheet metal stamping press 120 with a male punch 126 and female die 128 (see FIGS. 5 and 6). In step 102, the blank 124 is then drawn in the press 120 into doctoring cup 12 using a second set of dies. The doctoring cup 12 is formed by wrapping the blank 124 over a cylindrical male die 132 with a female die 130 (see FIGS. 7 and 8). In step 104, the rim of the doctoring cup 12 is trimmed on a lathe. In step 106, the doctoring cup 12 is hardened through heat-treating.

Figure 5:
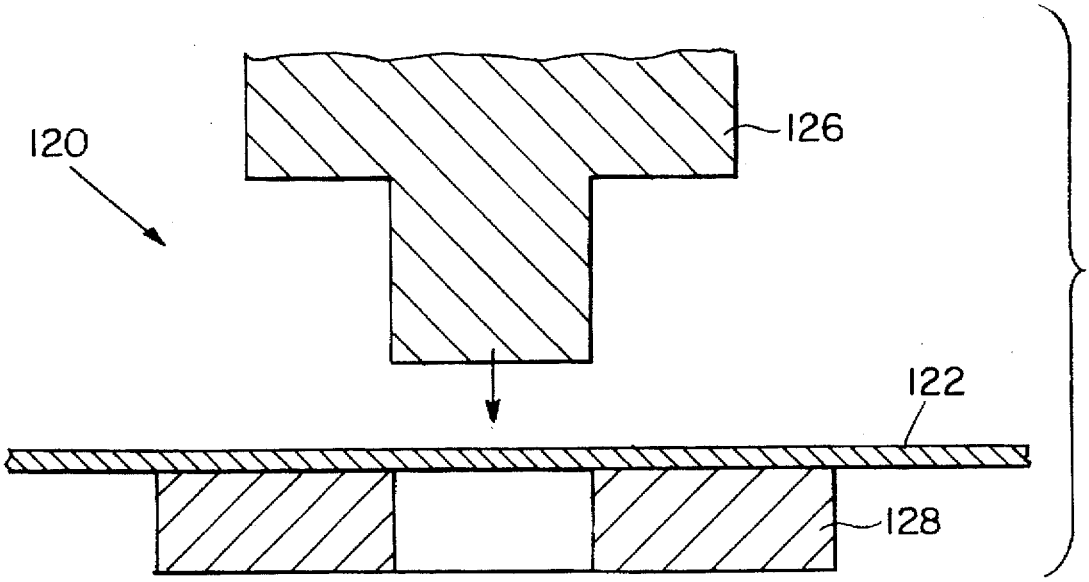
FIGS. 5 and 6 are side sectional views of a punch and die in a sheet metal stamping press punching a blank.
Figure 6:
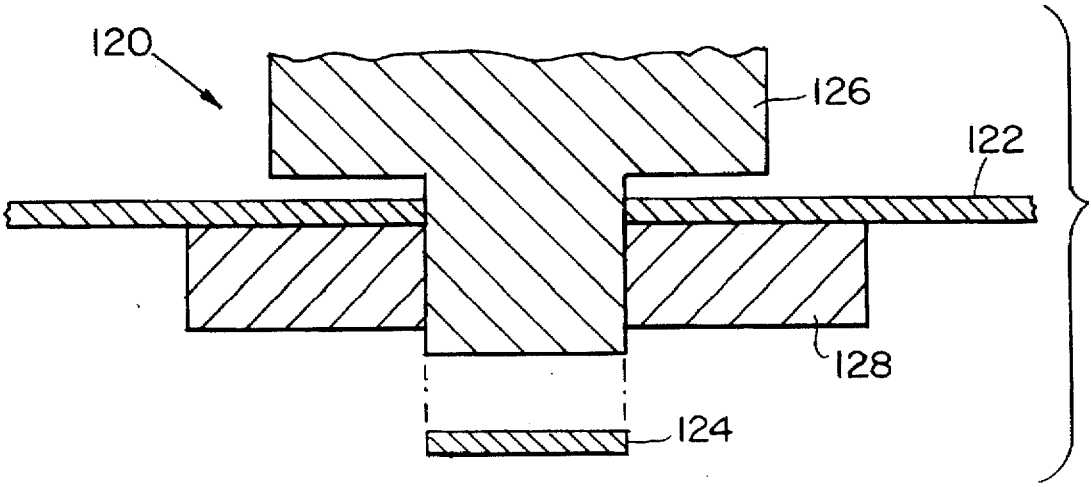
Figure 7:
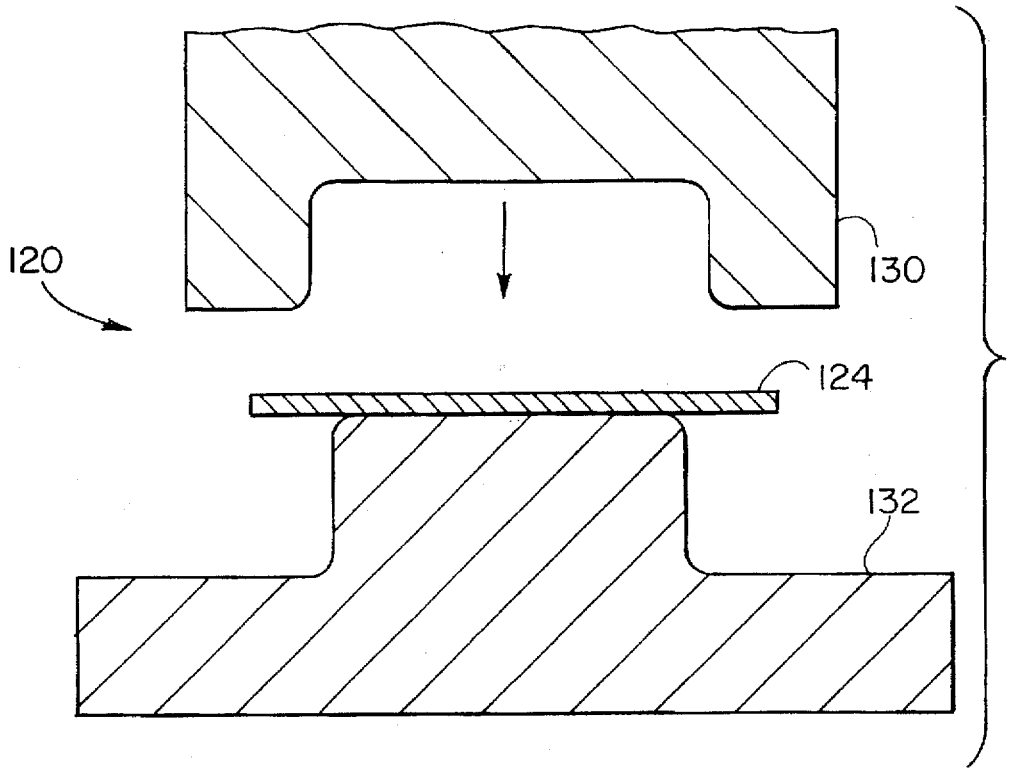
FIGS. 7 and 8 are side sectional views of a doctoring cup being drawn on the sheet metal stamping press with a male cylindrical die and a female die.
Figure 8:
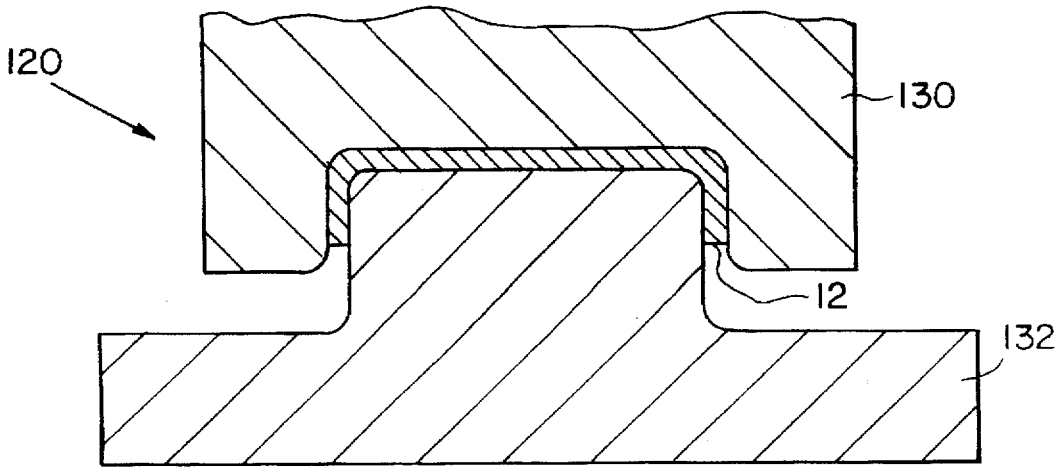

In step 108, a circular blank for the stiffening cup 10 is punched out in the press 120 with a third set of dies (a punch and die set similar to that depicted in FIGS. 5 and 6). In step 110, the blank for the stiffening cup 10 is then drawn in the press into a cup shaped member with a fourth set of dies (similar to the set depicted in FIGS. 7 and 8) to form the stiffening cup 10. In step 112, the rim 10*a* of the stiffening cup 10 is trimmed.

In step 114, the doctoring cup 12 and stiffening cup 12 are assembled together by pressing the doctoring cup 12 into the stiffening cup 10 and bonding the cups together with epoxy. In step 116, the doctoring edge 12*a* of the doctoring cup 12 is lapped flat with an abrasive to provide a flat and consistent doctoring edge 12*a*.

By employing sheet metal stamping technology to form ink cup 8, a closed ink cup is provided which is low cost and easily mass produced. Additionally, the flexibility of the doctoring edge can be controlled so that the present invention ink cup can be used with either precision ground printing plates or non-precision ground printing plates.

Stiffening cup 10 is preferably drawn from a sheet of steel but alternatively, can be made of other suitable materials such as aluminum, cast iron, bronze, brass, titanium, ceramics, plastics and composite materials. Stiffening cup 10 can be molded in a mold, formed on a lathe or milling machine, or assembled from a sheet or sheets of material. Additionally, although the doctoring cup 12 and stiffening cup 10 are preferably bonded together with epoxy, alternatively, stiffening cup 10 can be bonded to doctoring cup 12 by other suitable adhesives or by brazing or welding.

Although the steps of blanking and drawing each cup have been described as being performed in two steps, alternatively, a compound die can be employed to perform both blanking and drawing in one stroke of the press. Also, more than one press can be used. The blanks can also be cut with a laser or band saw instead of with a punch and die. Additionally, although the rims of the cups are preferably trimmed on a lathe, trimming can be performed by other suitable machinery such as a milling machine or a belt sander. Furthermore, doctoring cup 12 can be hardened by other suitable means such as flame hardening, induction hardening or nitriding. In some instances, it is desirable not to harden doctoring cup 12.

Figure 9:
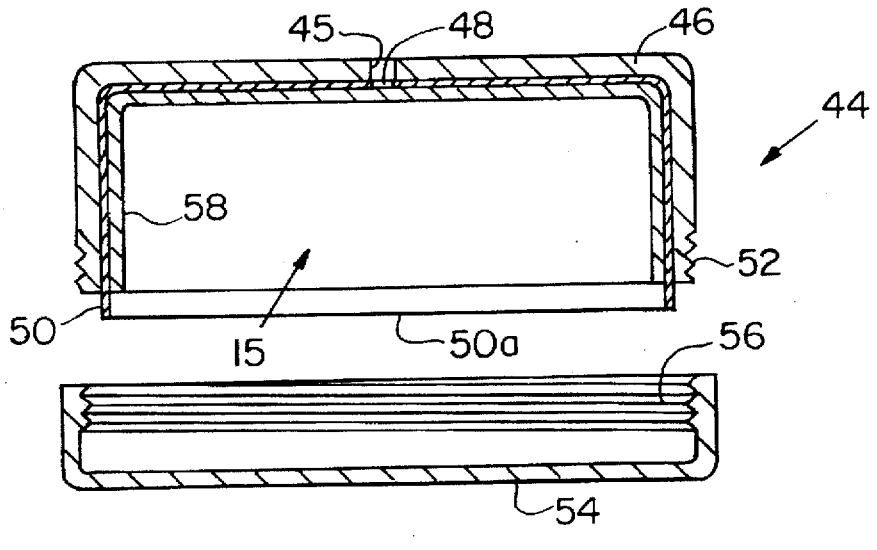
FIG. 9 is a side sectional view of another preferred ink cup.

Referring to FIG. 9, ink cup 44 is another preferred embodiment of the present invention. Ink cup 44 includes a doctoring cup 50 having a doctoring edge 50*a*. Doctoring cup 50 is sandwiched between an inner support cup 58 and an outer stiffening cup 46. Doctoring cup 50, inner support cup 58 and outer stiffening cup 46 are manufactured by the methods described above. The three cups can be bonded together, or press fitted together without bonding. The doctoring cup 50 and the outer stiffening cup 46 include holes 48 and 45 respectively which allow them to be assembled together. A cover 54 can optionally be included to enclose the reservoir 15 of ink cup 44 allowing ink to be stored in the ink cup 44 as when a change in ink color is required. The cover even allows the ink cup to be filled with ink when sold. Cover 54 is preferably plastic and is attached to ink cup 44 by mating threads 52 and 56. Alternatively, cover 54 can be attached by any other suitable means such as with a snap fit cover or adhesives. Additionally, cover 54 can be a plastic or metal film which is bonded to ink cup 44 and merely peeled off.

Figure 10:
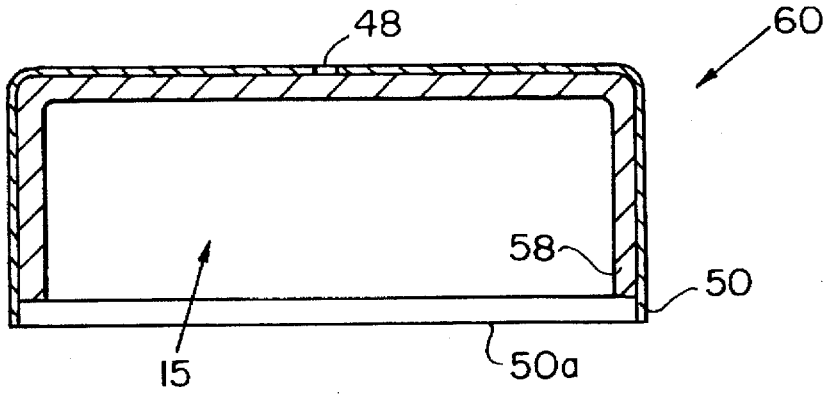
FIG. 10 is a side sectional view of still another preferred ink cup.

Referring to FIG. 10, ink cup 60 is another preferred embodiment of the present invention which is similar to ink cup 8 except that doctoring cup 50 is bonded to an inner stiffening cup 58.

Figure 11:
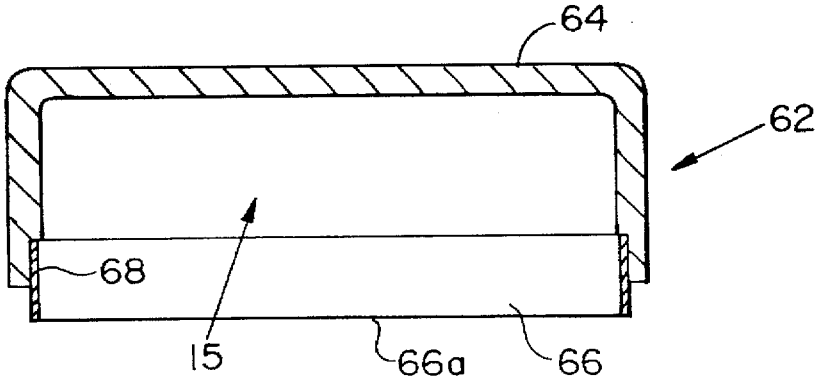
FIG. 11 is a side sectional view of another embodiment of the present invention ink cup.

Referring to FIG. 11, ink cup 62 is another embodiment of the present invention which includes an outer stiffening cup 64 and an inner doctoring band 66 having a doctoring edge 66*a*. The doctoring band 66 is bonded to stiffening cup 64 on a step 68. Step 68 is cut either on a lathe or on a milling machine. The outer stiffening cup 64 is manufactured by any of the methods described above. Doctoring band 66 is manufactured by drawing a cup shaped member having a continuous wall from a blank of unhardened spring steel. The bottom of the cup shaped member is then removed through a cutting or punching operation leaving behind the wall to form a doctoring band. The rims or edges of the doctoring band 66 are trimmed and then the doctoring band 66 is hardened. After assembly, the edges of the doctoring band 66 are lapped to provide a consistent doctoring edge 66*a*.

Figure 12:
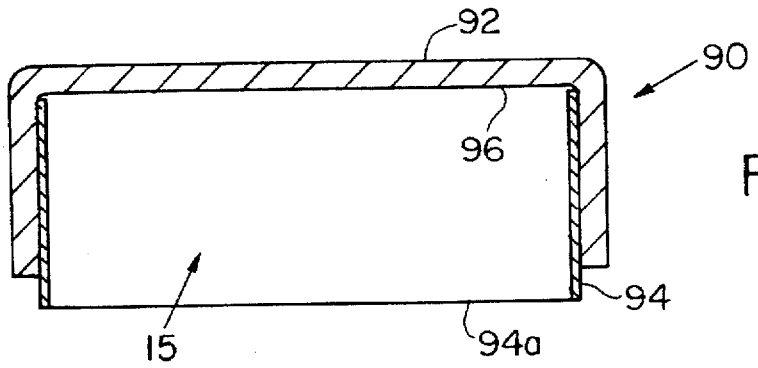
FIG. 12 is a side sectional view of still another embodiment of the present invention ink cup.

Referring to FIG. 12, ink cup 90 is another embodiment of the present invention. Ink cup 90 is similar to ink cup 62 but differs in that doctoring band 94 extends to the roof 96 of stiffening cup 92 and does not require a step 68. Typically, doctoring band 94 is bonded to stiffening cup 92. However, instead of bonding doctoring band 94 to stiffening cup 92, an inner support cup can be press fitted to sandwich the doctoring band 94 between two cups as in FIG. 9. Additionally, although the stiffening member 92 is shown to be cup shaped with the doctoring member being band shaped, alternatively, the stiffening member 92 can be band shaped and the doctoring member can be cup shaped. Furthermore, the doctoring member can be fitted about the stiffening member.

Figure 13:
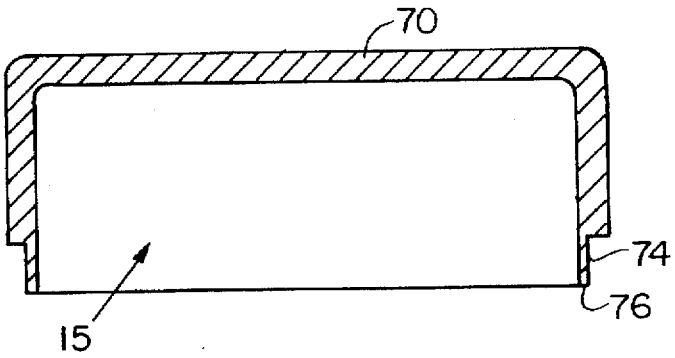
FIG. 13 is a side sectional view of another embodiment of the present invention ink cup.

Referring to FIG. 13, ink cup 70 is another embodiment of the present invention. Ink cup 70 is a one-piece ink cup which is blanked and drawn from a sheet of unhardened spring steel in a press. The spring steel is of sufficient thickness so that ink cup 72 is rigid. The rim of ink cup 70 is cut in a lathe or computer controlled milling machine to form a narrow portion 74 which serves as a doctoring edge 76. The ink cup 70 is then hardened by heat treating or by other suitable methods.

Figure 14:
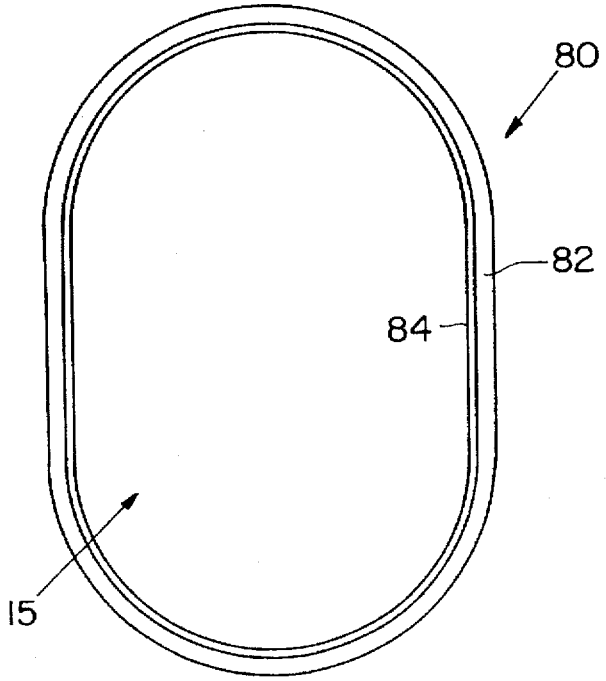
FIG. 14 is a front view of a preferred ink cup having an oval doctoring edge and interior.

Referring to FIG. 14, ink cup 80 is another preferred embodiment of the present invention. Ink cup 80 is an oval ink cup for use on wide printing plates. Ink cup 80 includes an outer stiffening cup 82 bonded to an inner doctoring cup 84. The blanks for forming the doctoring cup 84 and stiffening cup 82 would typically be oval shaped. Since oval shaped ink cups are generally large and are commonly machined from a single block of steel, they are typically very expensive. Ink cup 80 provides an ink cup at a significantly reduced cost. Any of the cup designs or methods of manufacture depicted in FIGS. 1 through 13 and discussed above can be employed for making an oval ink cup.

Equivalents

While this invention has been particularly shown and described with references to preferred embodiments thereof, it will be understood by those skilled in the art that various changes in form and details may be made therein without departing from the spirit and scope of the invention as defined by the appended claims. Although the ink cups described above have either circular or oval rims, ink cups having rims of other shapes can be employed. These rim shapes can have any combination of curved and straight sections. The term "cup shaped" is meant to encompass cups of all shapes as long as the cup has a closed end and continuous wall terminating in a rim. The doctoring and stiffening cups can have sloping walls, either inwardly or outwardly. Furthermore, any of the ink cups discussed above can be fitted with a cover to enclose the reservoir of the ink cup.

What is claimed is:

1. A doctoring ink cup comprising:

a flexible doctoring member of sheet metal, the doctoring member being cup shaped and having a rim forming a doctoring edge; and a stiffening member assembled in engagement with the doctoring member for stiffening the doctoring member against lateral flexing.

2. The ink cup of claim 1 in which the doctoring member and the stiffening member are bonded together.

3. The ink cup of claim 2 in which the doctoring member is bonded within the stiffening member.

4. The ink cup of claim 3 in which the stiffening member is cup shaped.

5. The ink cup of claim 1 in which the stiffening member is cup shaped.

6. The ink cup of claim 5 in which the stiffening member is made of sheet material.

7. The ink cup of claim 5 in which the stiffening member is made of moldable material.

8. The ink cup of claim 1 further comprising a secondary support member fitted within the doctoring member.

9. The ink cup of claim 8 in which the secondary support member is cup shaped.

10. The ink cup of claim 1 in which the doctoring member is formed of hardened spring steel.

11. The ink cup of claim 1 in which the doctoring member has a wall ranging from about 0.008 inches to 0.015 inches thick.

12. The ink cup of claim 1 further comprising a removable cover for enclosing the ink cup.

13. A doctoring ink cup comprising:

a flexible cup shaped doctoring member drawn from sheet metal, the doctoring member having a rim forming a doctoring edge; and a cup shaped stiffening member bonded to the doctoring member for stiffening the doctoring member against lateral flexing, the doctoring member being bonded within the stiffening member.

14. A doctoring ink cup comprising a cup shaped doctoring member drawn from sheet metal.

15. A doctoring ink cup in a pad-type printing system comprising:

a flexible doctoring member of sheet metal, the doctoring member being cup shaped and having a rim forming a doctoring edge; and a stiffening member assembled in engagement with the doctoring member for stiffening the doctoring member against lateral flexing.

16. A doctoring ink cup in a pad-type printing system comprising:

a flexible cup shaped doctoring member drawn from sheet metal, the doctoring member having a rim forming a doctoring edge; and a cup shaped stiffening member bonded to the doctoring member for stiffening the doctoring member against lateral flexing, the doctoring member being bonded within the stiffening member.

17. A doctoring ink cup in a pad-type printing system comprising a cup shaped doctoring member drawn from sheet metal.

18. An ink cup holder for pressing a cup shaped doctoring ink cup against a printing plate, the ink cup having a rim forming a doctoring edge, the ink cup holder comprising a recess in the ink cup holder for receiving and retaining the ink cup, the recess having a surface with a protrusion extending into the recess at a central location of the recess for pressing against the center of the ink cup such that the doctoring edge is evenly pressed against the printing plate.

* * * * *